US008401406B2

(12) United States Patent
Nose

(10) Patent No.: US 8,401,406 B2
(45) Date of Patent: Mar. 19, 2013

(54) IMAGE FORMING APPARATUS WITH FORCED TONER CONSUMPTION

(75) Inventor: Katsuya Nose, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 12/859,371

(22) Filed: Aug. 19, 2010

(65) Prior Publication Data

US 2011/0052220 A1 Mar. 3, 2011

(30) Foreign Application Priority Data

Aug. 26, 2009 (JP) ..... 2009-195702

(51) Int. Cl.
*G03G 15/08* (2006.01)

(52) U.S. Cl. ..... 399/27; 399/94

(58) Field of Classification Search ..... 399/9, 24, 399/27–30, 38, 53, 58, 61–65, 94
See application file for complete search history.

(56) References Cited

U.S. PATENT DOCUMENTS

| | | | | |
|---|---|---|---|---|
| 7,269,364 | B2 * | 9/2007 | Tanaka et al. | 399/27 |
| 7,272,331 | B2 * | 9/2007 | Kobayashi et al. | 399/44 |
| 7,352,977 | B2 * | 4/2008 | Nakano et al. | 399/30 |
| 7,664,435 | B2 | 2/2010 | Nose | |
| 7,844,191 | B2 * | 11/2010 | Endou et al. | 399/66 |
| 8,233,811 | B2 * | 7/2012 | Itoyama et al. | 399/30 |
| 8,280,264 | B2 * | 10/2012 | Inoue | 399/27 |
| 2010/0104296 | A1 | 4/2010 | Nose | |

FOREIGN PATENT DOCUMENTS

| | | | |
|---|---|---|---|
| JP | 2002-278399 | A | 9/2002 |
| JP | 2003-263027 | A | 9/2003 |
| JP | 2003-330319 | A | 11/2003 |
| JP | 2006-23327 | A | 1/2006 |
| JP | 2007-206118 | A | 8/2007 |
| JP | 2009-98160 | A | 5/2009 |

OTHER PUBLICATIONS

Notification of the First Office Action dated Feb. 28, 2012, in counterpart Chinese Application No. 201010265929.9.

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a developing device for developing a latent image formed on an image bearing member into a developer image; a transferring device for transferring the developer image from the image bearing member onto a transfer material; a temperature detecting sensor in a main assembly of the image forming apparatus, for detecting a temperature; and a controller for controlling a forced consumption operation in which toner is forcedly consumed by the developing device without transferring the developer image from the image bearing member onto the transfer material. The controller is capable of executing the forced consumption operation when toner consumption is below a predetermined threshold. The predetermined threshold is higher with higher temperature.

4 Claims, 15 Drawing Sheets

| TEMP. DEPENDENCE OF BLACK TONER DETERIORATION | | DEVICE TEMP. | | | |
|---|---|---|---|---|---|
| | | 20℃ | 30℃ | 40℃ | 50℃ |
| PRINT RATIO | 0% | × | × | × | × |
| | 1% | × | × | × | × |
| | 2% | ○ | × | × | × |
| | 3% | ○ | ○ | × | × |
| | 4% | ○ | ○ | ○ | × |
| | 5% | ○ | ○ | ○ | ○ |

Fig. 7

(a) THRESHOLD PRINT RATIO

| TEMP. | THRESHOLD PRINT RATIO (%) | | | |
|---|---|---|---|---|
| | Y | M | C | K |
| <25 | 2 | 2 | 2 | 2 |
| 25≦AND<35 | 3 | 3 | 3 | 3 |
| 35≦AND<45 | 4 | 4 | 4 | 4 |
| 45≦ | 5 | 5 | 5 | 5 |

(b) THRESHOLD VIDEO COUNT Vt

| TEMP. | DISCHARGE THRESHOLD (IMAGE DUTY %) | | | |
|---|---|---|---|---|
| | Y | M | C | K |
| <25 | 10 | 10 | 10 | 10 |
| 25≦AND<35 | 15 | 15 | 15 | 15 |
| 35≦AND<45 | 20 | 20 | 20 | 20 |
| 45≦ | 26 | 26 | 26 | 26 |

Fig. 8

| | COLOR | | | |
|---|---|---|---|---|
| | Y | M | C | K |
| PRINT RATIO (%) | 5 | 5 | 5 | 3 |
| VIDEO COUNT : V | 26 | 26 | 26 | 15 |
| THRESHOLD VIDEO COUNT : Vt | 10 - 26 | 10 - 26 | 10 - 26 | 15 - 26 |
| Vt - V | −16 - 0 | −16 - 0 | −16 - 0 | 0 - 11 |
| INTEGRATED VALUE : X | 0 | 0 | 0 | 0 - 11 |

Fig. 12

| TEMP. | THRESHOLD T (VIDEO COUNT/SEC) | | | |
|---|---|---|---|---|
| | Y | M | C | K |
| <25 | 15 | 15 | 15 | 15 |
| 25≦AND<35 | 22 | 22 | 22 | 22 |
| 35≦AND<45 | 29 | 29 | 29 | 29 |
| 45≦ | 37 | 37 | 37 | 37 |

Fig. 14

IMAGE FORMING APPARATUS WITH FORCED TONER CONSUMPTION

FIELD OF THE INVENTION AND RELATED ART

The present invention relates to an image forming apparatus, such as an electrophotographic copying machine or a laser beam printer, including a developing device for developing an electrostatic latent image formed no an image bearing member into a toner image.

Generally, in the image forming apparatus when a proportion in which image forming processing of an original having a low print ratio is large, a proportion of toner transferred from a developing sleeve in the developing device onto a photosensitive drum becomes small. In such a state, when the developing sleeve is continuously rotated for a long time, the toner is stirred and fed in the developing device. Further, the toner is sheared by stirring and rubbing with a stirring screw for supplying the toner to the developing sleeve or by rubbing with a regulating member for uniformizing a toner layer on the developing sleeve. As a result, an additive contained in the toner for controlling electric charges or flowability comes off or is buried in the toner surface, so that a charging property or the flowability is deteriorated.

As a result, when the image forming processing of the original having the low print ratio is continued, the toner deteriorated in charging property or flowability is increased in a developing container and on the developing sleeve. For that reason, degree of toner scattering, fog, graininess, and the like are deteriorated.

In order to solve such problems, the following operation was conventionally performed so that the toner did not remain in the developing container for a long time. That is, even in a state in which the image forming processing on a recording material (recording paper or the like) was not effected, the developing sleeve for carrying the toner was driven and rotated while being supplied with a predetermined voltage. As a result, the toner was transferred from the developing sleeve onto the photosensitive drum, so that the toner on the developing sleeve was removed. Then, a toner discharging operation (also referred to as toner forced consumption or toner refreshing processing) for removing the toner transferred on the photosensitive drum was performed.

For example, in Japanese Laid-Open Patent Application (JP-A) 2003-263027, when a drive rotation time of the developing sleeve reaches a predetermined time, an average amount of toner consumption with the predetermined time is estimated. Then, when the estimated value is lower than a threshold, the toner is judged that toner deterioration has gone and then a toner image is formed in a non-image area on the photosensitive drum in a predetermined pattern for toner discharging and is collected by a cleaner without being transferred onto the recording paper. In this way, a technique for forcedly discharging the deteriorated toner from the photosensitive drum in an amount corresponding to the toner image formed in the predetermined pattern has been proposed.

As a result, into the developing container, the toner which has not been deteriorated is supplied in an amount corresponding to the discharged amount of the deteriorated toner.

However, a method in which the average of the drive rotation time of the developing sleeve is taken as described in JP-A 2003-263027 is accompanied with a problem such that the ongoing deterioration cannot be accurately perceived and therefore good development cannot be effected in some cases.

That is, in the averaging method, the forced toner discharging operation cannot be performed until the image formation on the print ratio number of sheets effected for taking the average is completed. In the case where the image formation is continuously effected at the low print ratio, the toner deterioration goes abruptly, so that the good development cannot be carried out.

Further, it would be considered that a method of ensuring the good development by shorten an averaging interval (every one sheet in the extreme) is employed but there has arisen a problem such that downtime by the toner discharging operation in the non-image area and thus productivity is lowered.

Therefore, e.g., in JP-A 2006-023327, a control method in which the lowering in productivity is minimized while preventing a deterioration in image quality has been proposed. Specifically, in the case where a value which indicates the amount of the toner used every image formation (e.g., a video count value every image formation) is smaller than a preset threshold, a difference therebetween is calculated. The control method in which the forced toner discharging is executed when an integrated value obtained by integrating the calculated difference reaches a predetermined value has been proposed.

As a result, setting of the threshold for the amount of toner consumption by the image formation and setting of the threshold for the integrated value of the difference for judging whether or not the forced toner discharging should be executed are made properly. Thus, the forced toner discharging operation is not performed until moment before the lowering in image quality due to the toner deterioration occurs but can be performed immediately after the image quality deterioration is liable to occur. That is, the control which minimizes the lowering in productivity while preventing the image quality deterioration can be effected.

Here, the image forming apparatus capable of effecting the above-described control of the forced toner discharging operation (forced toner consumption) will be considered more specifically.

In the prior art, as described in JP-A 2003-263027 and JP-A 2006-023327, the toner discharging has been properly performed while paying attention to such a point that the toner deterioration in the developer depends on the rotation time of the developing sleeve and depends the toner consumption amount in the rotation time or while paying attention to such a point that the toner deterioration in the developer depends on the print ratio of the original to be subjected to the image formation. Thus, the methods for minimizing the lowering in productivity while retaining the image quality have been proposed.

However, in recent years, with speed-up of a copying machine, a lowering in melting point of the toner has been advanced in order to improve fixability. As a result, the above-described toner deterioration by the image formation not only depends on the print ratio of the original but also largely depends on a temperature in the image forming apparatus (or in the developing device or the developer in the developing device). Specifically, with a higher temperature, the toner deterioration tends to go earlier.

As a result, in the prior art which does not pay attention to the temperature in the image forming apparatus (or in the developing device or the developer in the developing device), the toner discharging operation is not sufficient when the temperature of the developer is increased by long-time continuous output of the image forming apparatus, a change in ambient environment, and the like. As a result, image quality deteriorations due to the toner deterioration such as an increase of toner scattering, fog deterioration, and deterioration of graininess are caused to occur. On the other hand, even the case where an execution frequency of the toner discharging operation is increased or an execution threshold of the toner discharging operation is lowered, when the temperature of the developer after long-time standing or the like is sufficiently low, the toner is discharged excessively. As a result, an increase in waste toner, a lowering in productivity, and an increase in running cost are caused.

SUMMARY OF THE INVENTION

Therefore, a principal object of the present invention is to provide an image forming apparatus, including a developing device and a toner discharging means for preventing the toner deterioration described above, capable of alleviating a lowering in productivity while preventing the toner deterioration by changing a toner discharging operation depending on a temperature in the developing device.

According to an aspect of the present invention, there is provided an image forming apparatus comprising:

a developing device for developing a latent image formed on an image bearing member into a developer image;

a transferring device for transferring the developer image from the image bearing member onto a transfer material;

temperature detecting means, disposed in a main assembly of the image forming apparatus, for detecting a temperature; and a controller for controlling a forced consumption operation in which toner is forcedly consumed by the developing device without transferring the developer image from the image bearing member onto the transfer material, wherein the controller is capable of controlling the forced consumption operation so that a frequency of the forced consumption operation or an amount of toner consumption per one forced consumption operation when the temperature detected by the temperature detecting means is higher than a predetermined temperature is more than that when the temperature detected by the temperature detecting means is lower than the predetermined temperature.

According to another aspect of the present invention, there is provided an image forming apparatus comprising:

a developing device for developing a latent image formed on an image bearing member into a developer image;

a transferring device for transferring the developer image from the image bearing member onto a transfer material;

temperature detecting means, disposed in a main assembly of the image forming apparatus, for detecting a temperature; and a controller for controlling a forced consumption operation in which toner is forcedly consumed by the developing device without transferring the developer image from the image bearing member onto the transfer material, wherein the controller is capable of controlling the forced consumption operation so that the forced consumption operation is performed when the temperature detected by the temperature detecting means is higher than a predetermined temperature and so that the forced consumption operation is not performed when the temperature detected by the temperature detecting means is lower than the predetermined temperature.

According to a further aspect of the present invention, there is provided an image forming apparatus comprising:

a developing device for developing a latent image formed on an image bearing member into a developer image;

a transferring device for transferring the developer image from the image bearing member onto a transfer material;

temperature detecting means, disposed in a main assembly of the image forming apparatus, for detecting a temperature; and a controller for controlling a forced consumption operation in which toner is forcedly consumed by the developing device without transferring the developer image from the image bearing member onto the transfer material, wherein the controller is capable of controlling the forced consumption operation so that an amount of toner consumption per unit drive time of the developing device when the temperature detected by the temperature detecting means is higher than a predetermined temperature is more than that when the temperature detected by the temperature detecting means is lower than the predetermined temperature.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 is a table showing temperature dependence of black toner deterioration in Embodiment 1.

FIGS. 8(*a*) and 8(*b*) are tables each showing temperature dependence of a toner deterioration threshold for each of colors.

FIG. 12 is a table for illustrating the toner discharging control in the image forming apparatus in Embodiment 1.

FIG. 14 is a table for illustrating the toner discharging control in the image forming apparatus in Embodiment 2.

DESCRIPTION OF THE PREFERRED EMBODIMENTS (Embodiment 1)

Hereinbelow, an image forming apparatus as a first embodiment of the present invention will be described in detail.

<Image Forming Apparatus>

Figure 1:
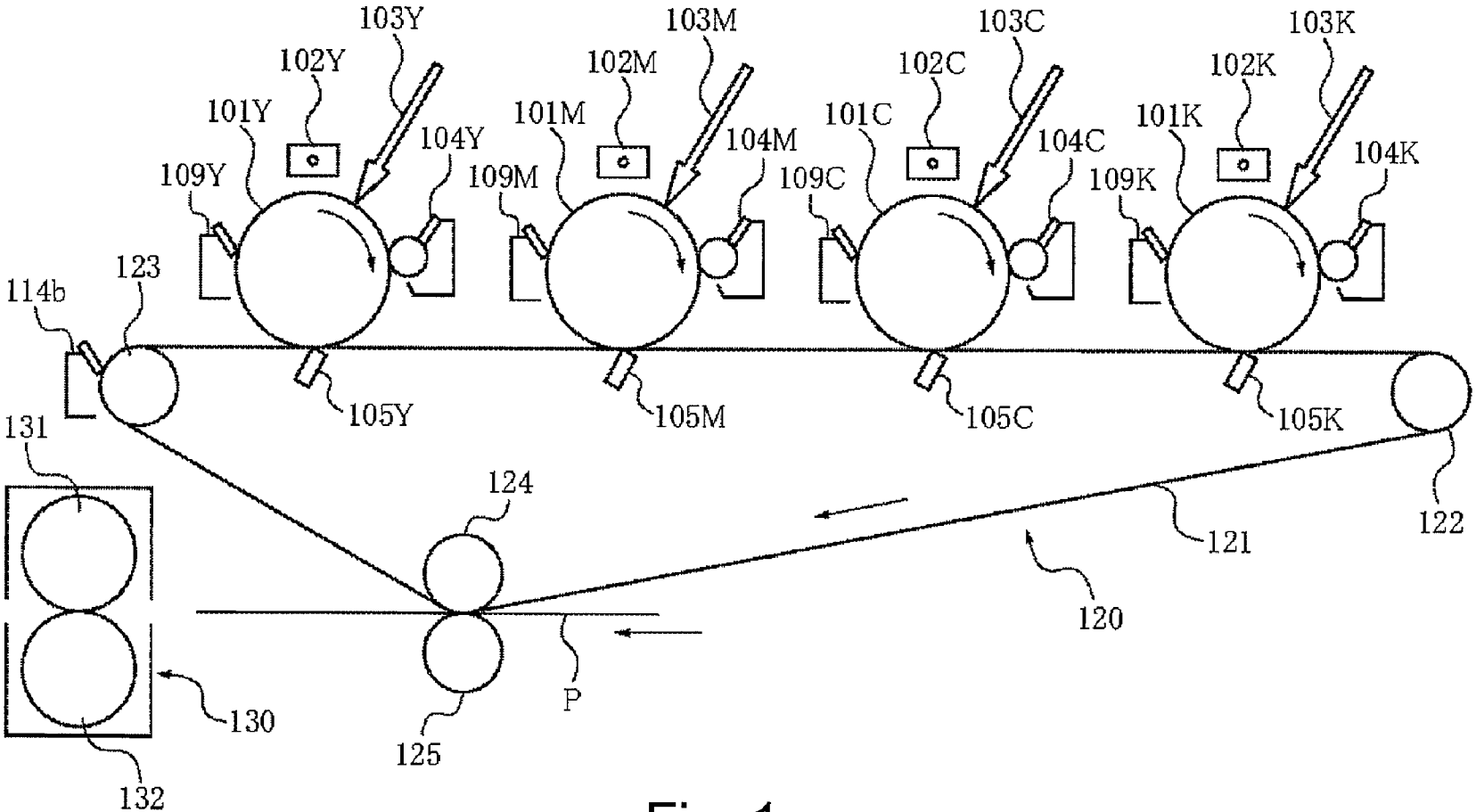
FIG. 1 is a schematic view of an image forming apparatus to which the present invention is applicable.

As shown in FIG. 1, the image forming apparatus in this embodiment includes four image forming stations Y, M, C and K provided with photosensitive drums 101 (101Y, 101M, 101C and 101K, respectively) as a latent image bearing member. Under each of the image forming stations, an intermediary transfer device 120 is disposed. The intermediary transfer device 120 is constituted so that an intermediary transfer belt 121 as an intermediary transfer member is stretched by rollers 122, 123 and 124 and is moved in a direction indicated by an arrow.

In this embodiment, the surface of the photosensitive drum 101 electrically charged by a primary charging device 102 (102Y, 102M, 102C and 102K) of a corona charging type in which non-contact charging is effected is exposed to light by a laser 103 (103Y, 103M, 103C and 103K) driven by an unshown laser driver. As a result, an electrostatic latent image is formed on the photosensitive drum 101. The latent image is developed by each of developing devices 103 (104Y, 104M, 104C and 104K), so that toner images (developer images) of yellow, magenta, cyan and black are formed.

The toner images formed at the respective image forming stations are transferred and superposed on the intermediary transfer belt 121 of polyimide resin by a transfer bias with transfer blades 105 (105Y, 105M, 105C and 105K) as a primary transfer means. The four-color toner images transferred on the intermediary transfer belt 121 are transferred onto recording paper P as a transfer material by a secondary transfer roller 125 as a secondary transfer means disposed opposite to the roller 124. The toner remaining on the intermediary transfer belt 121 without being transferred onto the recording paper P is removed by an intermediary transfer belt cleaner 114*b*. The recording paper P on which the toner images are transferred is pressed and heated by a fixing device 130 including fixing rollers 131 and 132, so that a permanent image is obtained. Further, primary transfer residual toners remaining on the photosensitive drums 101 after the primary transfer are removed by cleaners 109 (109Y, 109M, 109C and 109K), so that the image forming apparatus prepares for subsequent image formation.

<Constitution of Photosensitive Drum and Its Adjacent Members in Image Forming Apparatus>

Further, with reference to FIG. 2, a constitution of each photosensitive drum as the latent image bearing member and its adjacent members in the image forming apparatus in this embodiment will be described more specifically. Here, the photosensitive drums for the respective colors and their adjacent members have the same constitution and therefore the photosensitive drum for a certain color will be representatively described.

Figure 2:
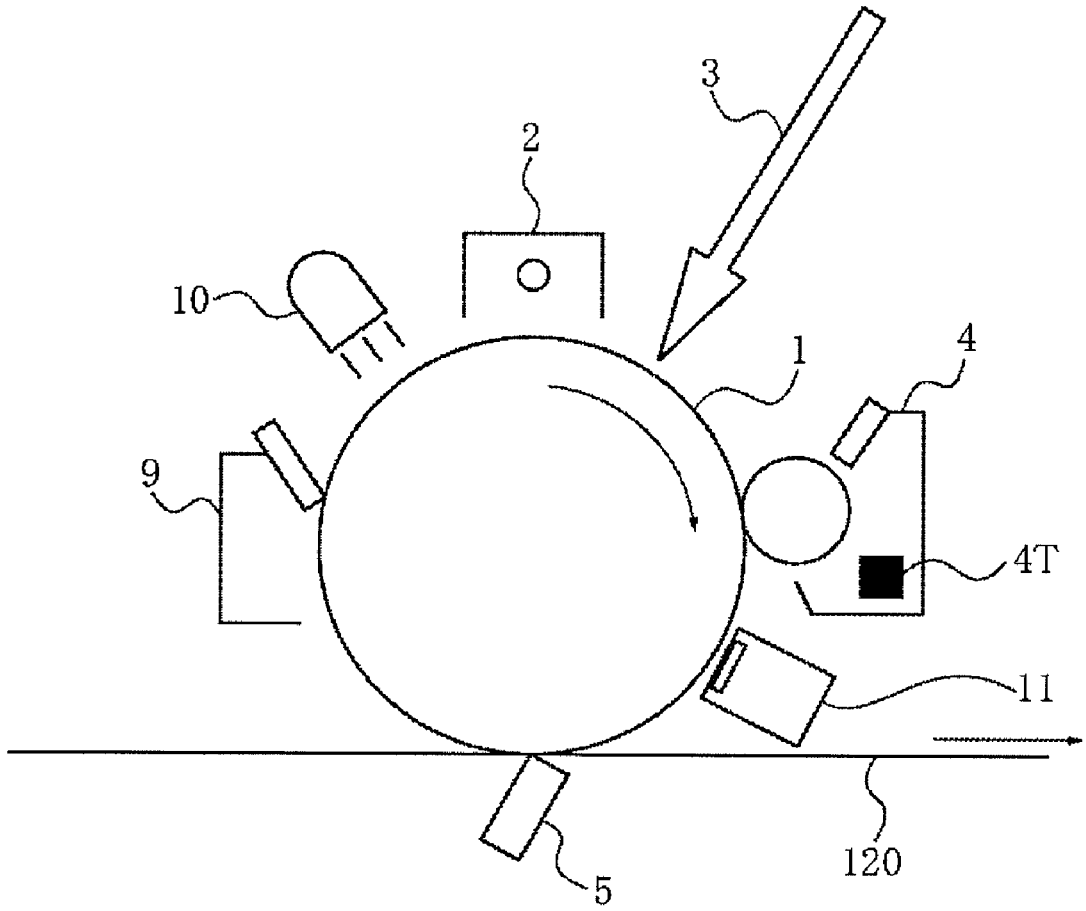
FIG. 2 is a schematic view showing a constitution of a photosensitive drum of the image forming apparatus and members disposed around the photosensitive drum.

Referring to FIG. 2, in the image forming apparatus in this embodiment, a photosensitive drum 1 as the electrostatic latent image bearing member is rotatably provided. The surface of the photosensitive drum 1 uniformly charged by a primary charging device 2 of a non-contact charging type (corona type) is exposed to light by a laser emitting element 3, so that the electrostatic latent image is formed on the photosensitive drum 1. This electrostatic latent image is visualized (developed) by a developing device 4 into a visible image. Then, the visible image is transferred onto the intermediary transfer belt 121 (of the intermediary transfer device 120) by a transfer blade 5. Further, the transfer residual toner on the photosensitive drum 1 is removed by a cleaning device 9 of a cleaning blade contact type. Further, a potential on the photosensitive drum 1 is erased (removed) by a pre-exposure lamp 10 and then the photosensitive drum 1 is subjected to the image formation again. Further, in the developing device 4, a band gap temperature sensor 4T as a temperature detecting means 4T for the developer in the developing device 4 is disposed.

<Image Processing>

Figure 3:
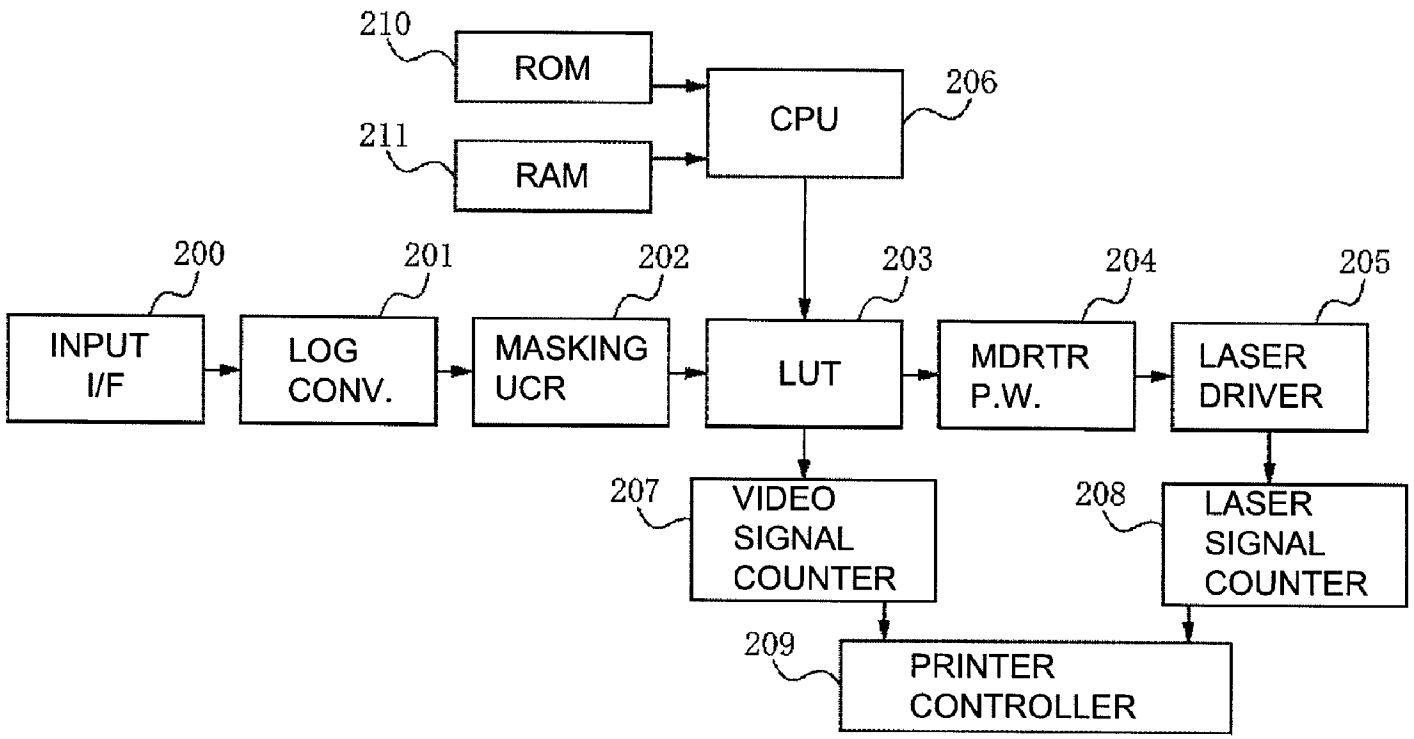
FIG. 3 is a block diagram showing a system constitution of an image processing unit of the image forming apparatus.

In a block diagram of FIG. 3, a system constitution of an image processing unit in the image forming apparatus in this embodiment is shown.

Referring to FIG. 3, through an external input interface (I/F) 200, color image data as RGB image data are input from an unshown external device such as an original scanner or a computer (information processing device) as desired. A LOG conversion portion 201 converts luminance data of the input RGB image data into CMY density data (CMY image data) on the basis of a look-up table constituted (prepared) by data or the like stored in an ROM 210. A masking UCR portion 202 extracts a black (K) component data from the CMY image data and subjects CMYK image data to matrix operation in order to correct color shading of a recording colorant. A look-up table portion (LUT portion) 203 makes density correction of the input CMYK image data every color by using a gamma (γ) look-up table in order that the image data are caused to coincide with an ideal gradation characteristic of a printer portion. Incidentally, the γ look-up table is prepared on the basis of the data developed on an RAM 211 and the contents of the table are set by a CPU 206. A pulse width modulation portion 204 outputs a pulse signal with a pulse with corresponding to image data (image signal) input from the LUT portion 203. On the basis of this pulse signal, a laser driver 205 drives the laser emitting element 3 to irradiate the surface of the photosensitive drum 1 with laser light, so that the electrostatic latent image is formed on the photosensitive drum 1.

A video signal count portion 207 adds up a level for each pixel (0 to 255 level) for a screenful of the image with respect to 600 dpi of the image data input into the LUT portion 203. The integrated value of the image data is referred to as a video count value. A maximum of this video count value is 1023 in the case where all the pixels for the output image are at the 255 level. Incidentally, there is a restriction on the constitution of the circuit, by using a laser signal count portion 208 in place of the video signal count portion 207, the image signal from the laser drive 205 is similarly calculated, so that it is possible to obtain the video count value.

<Constitution of Developing Device>

Figure 4:
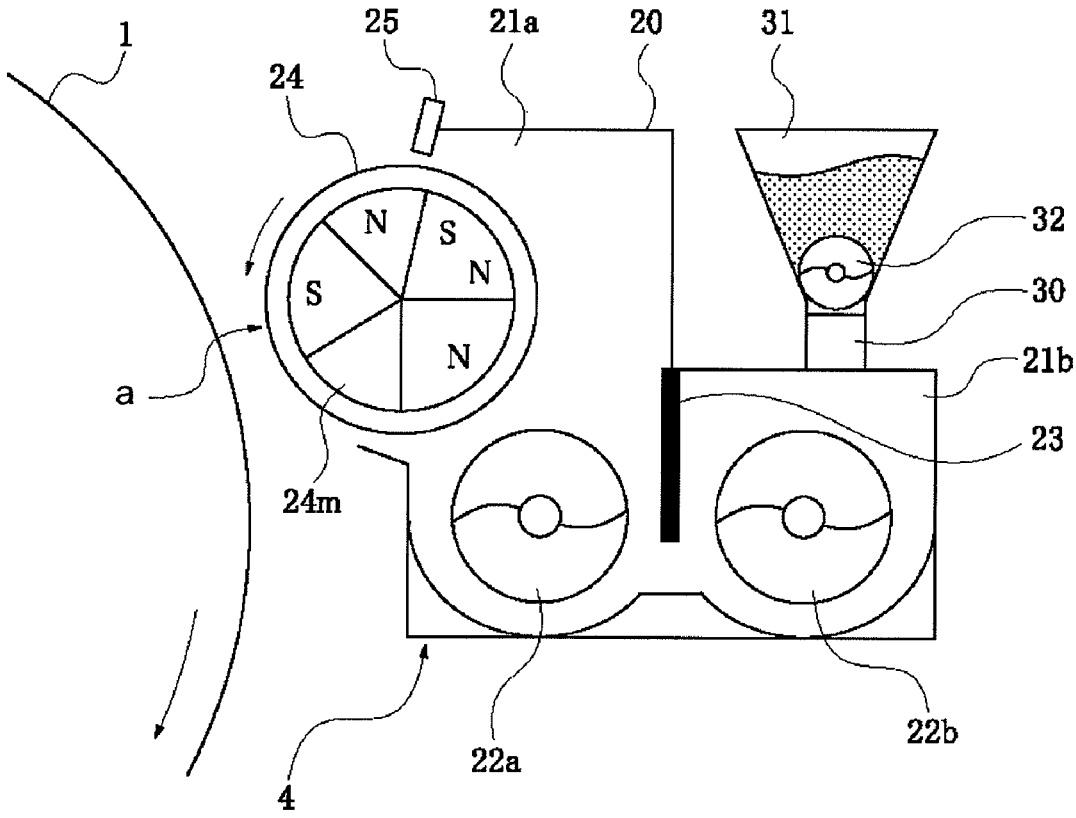
FIGS. 4 and 5 are schematic views each of a developing device provided in the image forming apparatus.
Figure 5:
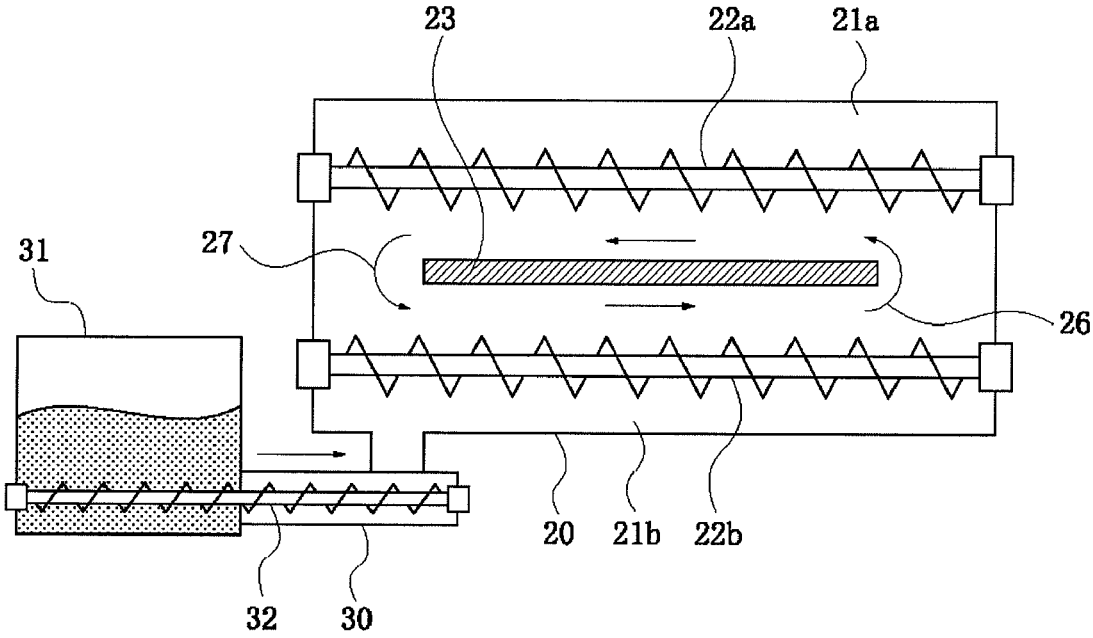

The developing device 4 will be further described more specifically with reference to FIG. 4 and FIG. 5. The developing apparatus 4 in this embodiment includes a developing container 20, in which a two component developer including toner and a carrier is stored. The developing apparatus 4 also includes a developing sleeve 24 as a developer carrying member and a trimming member 25 for regulating a magnetic brush chain formed of the developer carried on the developing sleeve 24, in the developing container 20.

In this embodiment, the inside of the developing container 20 is horizontally divided by a partition wall 23 into a developing chamber 21*a* and a stirring chamber 21*b*. The partition wall 23 extends in the direction perpendicular to the drawings of FIGS. 4 and 5. The developer is stored in the developing chamber 21*a* and the stirring chamber 21*b*.

In the developing chamber 21*a* and the stirring chamber 21*b*, first and second feeding screws 22*a* and 22*b* which are feeding members as developer stirring and feeding means are disposed, respectively. The first feeding screw 22*a* is disposed, at the bottom portion of the developing chamber 21*a*, roughly in parallel to the axial direction of the developing sleeve 24. It conveys the developer in the developing chamber 21*a* in one direction parallel to the axial line of the developing sleeve 24 by being rotated. The second feeding screw 22*b* is disposed, at the bottom portion of the stirring chamber 21*b*, roughly in parallel to the first feeding screw 22*a*. It conveys the developer in the stirring chamber 21*b* in the direction opposite to that of the first feeding screw 22*a*.

Thus, by the feeding of the developer through the rotation of the first and second feeding screws 22*a* and 22*b*, the developer is circulated between the developing chamber 21*a* and the stirring member 21*b* through openings 26 and 27 (that is, communicating portions) present at both ends of the partition wall 23 (FIG. 5).

In this embodiment, the developing chamber 21*a* and the stirring chamber 21*b* are horizontally disposed. However, the present invention is also applicable to a developing device in which the developing chamber 21*a* and the stirring chamber 21*b* are vertically disposed and developing devices of other types.

In this embodiment, the developing container 20 is provided with an opening at a position corresponding to a developing area A wherein the developing container 20 opposes the photosensitive drum 1. At this opening, the developing sleeve 24 is rotatably disposed so as to be partially exposed toward the photosensitive drum 1.

In this embodiment, the diameters of the developing sleeve 24 and the photosensitive drum 1 are 20 mm and 80 mm, respectively, and a distance in the closest area between the developing sleeve 24 and the photosensitive drum 1 is about 400 μm. By this constitution, development can be effected in a state in which the developer fed to the developing area A is brought into contact with the photosensitive drum 1.

Incidentally, the developing sleeve 24 is formed of nonmagnetic material such as aluminum and stainless steel and inside thereof a magnetic roller 24*m* as a magnetic field generating means is non-rotationally disposed.

In the constitution described above, the developing sleeve 24 is rotated in the direction indicated by an arrow (counterclockwise direction) to carry the two component developer regulated in its layer thickness by cutting of the chain of the magnetic brush with the trimming member 25. Then, the developing sleeve 24 conveys the layer thickness-regulated developer to the developing area A in which the developing sleeve 24 opposes the photosensitive drum 1, and supplies the developer to the electrostatic latent image formed on the photosensitive drum 1, thus developing the latent image. At this time, in order to improve development efficiency, i.e., a rate of the toner imparted to the latent image, a developing bias voltage in the form of a DC voltage biased or superposed with an AC voltage is applied to the developing sleeve 24 from a power source. In this embodiment, the developing bias is a combination of a DC voltage of −500 V, and an AC voltage which is 1,800 V in peak-to-peak voltage Vpp and 12 kHz in frequency f. However, the DC voltage value and the AC voltage waveform are not limited to those described above.

In the two component magnetic brush developing method, generally, the application of AC voltage increases the development efficiency and therefore the image has a high quality but on the other hand, fog is liable to occur. For this reason, by providing a potential difference between the DC voltage applied to the developing sleeve 24 and the charge potential of the photosensitive drum 1 (i.e., a white background portion potential), the fog is prevented.

The regulating blade 25 as the trimming member is constituted by a nonmagnetic member is formed with an aluminum plate or the like extending in the longitudinal axial direction of the developing sleeve 24. The regulating blade 29 is disposed upstream of the photosensitive drum 1 with respect to the developing sleeve rotational direction. Both the toner and the carrier of the developer pass through the gap between an end of the trimming member 25 and the developing sleeve 24 and are sent into the developing area A. Incidentally, by adjusting the gap between the regulating blade 25 and the developing sleeve 24, the trimming amount of the magnetic brush chain of the developer carried on the developing sleeve 24 is regulated, so that the amount of the developer sent into the developing area A is adjusted. In this embodiment, a coating amount per unit area of the developer on the developing sleeve 24 is regulated at 30 mg/cm$^2$ by the regulating blade 25.

The gap between the regulating blade 25 and the developing sleeve 24 is set at a value in the range of 200-1,000 μm, preferably, 300-700 μm. In this embodiment, the gap is set at 500 μm.

Further, in the developing area A, the developing sleeve 24 of the developing device 4 moves in the same direction as the movement direction of the photosensitive drum 1 at a peripheral speed ratio of 1.75 by which the developing sleeve 24 moves at the peripheral speed which is 1.75 times that of the photosensitive drum 1. With respect to the peripheral speed ratio, any value may be set as long as the set value is in the range of 0-3.0, preferably, 0.5-2.0. The greater the peripheral (moving) speed ratio, the higher the development efficiency. However, when the ratio is excessively large, problems such as toner scattering and developer deterioration occur. Therefore, the ratio is desired to be set in the above-mentioned range.

Further, at the opening (communicating portion) 26 in the developing container 20, as a temperature detecting means for detecting information relating to the temperature in the developing device, the band gap temperature sensor 4T is disposed. The bade gap temperature sensor 4T is disposed in the developing device so as to be buried in the developer and directly detects the temperature of the developer. The disposition place of the temperature sensor in the developing container 20 may desirably be a position in which a sensor surface is buried in the developer in order to improve detection accuracy but is not limited thereto. Although the accuracy is somewhat lowered, it is also possible to employ a constitution in which the temperature in the developing device is detected by using the temperature sensor provided in the image forming apparatus main assembly.

Figure 6:
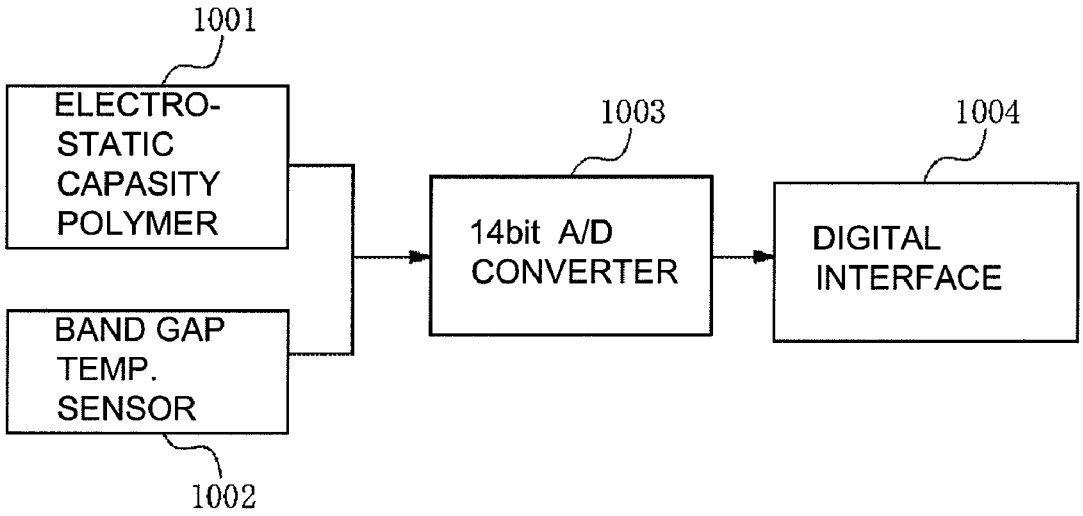
FIG. 6 is a control block diagram of a temperature sensor provided in the image forming apparatus.

Here, the temperature sensor 4T will be described more specifically. In this embodiment, as the temperature sensor 4T, a temperature/humidity sensor ("SHT1X series", mfd. by Sensiron Co., Ltd.) was used. As shown in FIG. 6, the temperature sensor 4T includes a sensing element 1001 of an electrostatic capacity polymer as a humidity detecting device and includes a band gap temperature sensor 1002 as a temperature detecting device. The temperature sensor 4T is a CMOS device having such a specification that outputs of the sensing element 1001 and band gap temperature sensor 1002 are coupled by a 14 bit-A/D converter 1003 and serial output is performed through a digital interface 1004. The band gap temperature sensor 1002 as the temperature detecting device uses a thermistor linearly changed in resistance value with respect to the temperature and calculates the temperature from the resistance value. Further, the sensing element 1001 of the electrostatic capacity polymer as the humidity detecting device is a capacitor in which the polymer is inserted as a dielectric member. The sensing element 1001 of the electrostatic capacity polymer detects the humidity by converting the electrostatic capacity into the humidity by utilizing such a property that the content of water which is adsorbed by the polymer is changed depending on the humidity and as a result, the electrostatic capacity of the capacitor is linearly changed with respect to the humidity.

The temperature sensor 4T used in this embodiment can detect both of the temperature and the humidity. However, actually, only a detection result of the temperature is utilized, so that the use of other sensors capable of detecting only the temperature may also be sufficient.

<Developer in Developing Device>

Here, the two component developer used in this embodiment, which comprises the toner and the carrier, stored in the developing container 20 of the developing device 4 will be described more specifically.

The toner contains primarily binder resin, and coloring agent. If necessary, particles of coloring resin, inclusive of other additives, and coloring particles having external additive such as fine particles of colloidal silica, are externally added to the toner. The toner is negatively chargeable polyester-based resin and is desired to be not less than 4 μm and not more than 10 μm, preferably not more than 8 μm, in volume-average particle size.

As for the material for the carrier, particles of iron, the surface of which has been oxidized or has not been oxidized, nickel, cobalt, manganese, chrome, rare-earth metals, alloys of these metals, and oxide ferrite are preferably usable. The method of producing these magnetic particles is not particularly limited. A weight-average particle size of the carrier may be in the range of 20-60 μm, preferably, 30-50 μm. The carrier may be not less than $10^7$ ohm.cm, preferably, not less than $10^8$ ohm.cm, in resistivity. In this embodiment, the carrier with a resistivity of $10^8$ ohm.cm was used.

Incidentally, the volume-average particle size of the toner used in this embodiment was measured by using the following apparatus and method. As the measuring apparatus, a Coulter Counter T-II (mfd. by Coulter Co. Ltd.), an interface (mfd. by Nikkaki Bios Co., Ltd.) for outputting number-average distribution and volume-average distribution, and a personal computer (Model "CX-1", available from Canon K.K.) were used. As the electrolytic solution, a 1%-aqueous solution of reagent-grade sodium chloride was used.

The measuring method was as follows. To 100-150 ml of the electrolytic solution, 0.1 ml of a surfactant as a dispersant, preferably, alkylbenzenesulfonic acid salt, was added, and to this mixture, 0.5-50 mg of a measurement sample was added.

Then, the electrolytic solution in which the sample was suspended was placed in an ultrasonic dispersing device for roughly 1-3 minutes to disperse the sample. Then, the particle size distribution of the sample, the size of which is in the range of 2-40 μm was measured with the use of the above-mentioned Coulter Counter TA-II fitted with a 100 μm aperture, and the volume-average distribution was obtained. Then, a volume-average particle size was obtained from the thus-obtained volume-average distribution.

Further, the resistivity of the carrier used in this embodiment was measured by using a sandwich type cell with a measurement electrode area of 4 $cm^2$ and a gap between two electrodes of 0.4 cm. A voltage E (V/cm) was applied between the two electrodes while applying 1 kg of weight (load) to one of the electrodes, to obtain the resistivity of the carrier from the amount of the current which flowed through the circuit.

<Supplying Method of Developer Into Developing Device>

Next, referring to FIGS. 4 and 5, the method, for supplying (replenishing) the developer into the developing device in this embodiment will be described.

The developing device 4 is provided, at its upper portion, with a hopper 31 which accommodates a two-component developer for supply comprising a mixture of the toner and the carrier. In FIG. 5, for convenience of explanation, the hopper 31 is illustrated at a position in which it is located on the side surface side of the developing device 4. The hopper 31 which constitutes a toner supplying means is provided with a supply member, i.e., a supply screw 32, which is disposed at a lower portion of the hopper 31. One end of the supply screw 32 extends to a developer supply opening 30 of the developer container 20, which is located near the front end of developing device 4.

The developer container 20 is supplied with toner in an amount equal to the amount of the toner consumed for image formation, from the hopper 31 through the developer supply opening 30 by a rotational force of the supply screw 32 and the weight of the developer itself. In this manner, the developer for supply is supplied from the hopper 31 into the developing device 4.

The supply amount of the developer for supply can be roughly determined by the number of revolutions of the supply screw 32, and the number of revolutions is determined by an unshown toner supply amount controlling means on the basis of the above-described video count value of the image data and a detection result of a patch detection sensor 11, shown in FIG. 2, for detecting the density of a toner image by developing a reference latent image into the toner image.

<Control Method of Toner Forced Consumption>

Hereinafter, a control method of a toner forced consumption (toner discharging) operation which is a characteristic feature of the present invention will be described in detail.

First, in the case where the image formation at the low print ratio is continued in the image forming apparatus having the above-described constitution, the proportion of the toner transferred from the developing container 20 onto the photosensitive drum 1 is small. For this reason, the toner in the developing container 20 is subjected to stirring of the first and second feeding screws 22*a* and 22*b* and rubbing at the time of passing through the trimming member 25, for a long time. As a result, the above-described external additive for the toner comes off the toner or is buried in the toner surface, so that the flowability or charging property of the toner in deteriorated and thus the image quality is deteriorated.

Therefore, a method in which downtime is provided and the deteriorated toner in the developing device 4 is used for the development in a non-image area and thus is forcedly discharged (consumed) has been conventionally proposed. In the conventional method, by paying attention to a difference in degree of toner deterioration progression depending on the print ratio (i.e., a larger proportion of the deteriorated toner with a lower print ratio), a length of the downtime by the toner discharging operation or a toner discharging frequency is changed depending on the print ratio. Incidentally, the print ratio means an area of the toner image formed in a maximum image forming area, and is 100% for a solid black image and is 0% for a solid white image. In this embodiment, attention is also paid to the difference in degree of toner deterioration progression depending on the developer temperature or an ambient temperature in an environment in which the image forming apparatus is placed. That is, depending on not only the print ratio but also the detection result of the developer temperature detecting means 4T, a discharge amount of the developer unit time is changed. Specifically, depending on the detection result of the developer temperature detecting means 4T, the length of the downtime by the toner discharging operation (i.e., an execution time of the toner discharging operation) or the toner discharging frequency.

In the following, in this embodiment, the difference in degree of the toner deterioration progression depending on the developer temperature will be described first and then how to determine an operation condition of the toner forced consumption depending on the temperature and how to execute toner discharging operation will be described.

<Temperature Dependence of Toner Deterioration>

As described above, in the case where the proportion of the toner transferred onto the photosensitive drum is small and the amount of the toner supply into the developing container 20 is small, i.e., in the case where the print ratio is low, the toner deterioration has gone. Further, a speed of the toner deterioration progression varies depending on an environment in which the developing device is placed. The present inventor conducted the following experiment. That is, the developing device 4 is placed in various constant environments and in each of the constant environments, continuous one-side-image formation on 10,000 A4-sized sheets was effected while changing the print ratio (from 0% to 5%) for each of the colors, so that a change in image quality before and after the continuous image formation. A result of this experiment is shown only for black in the table of FIG. 7. In FIG. 7, the temperature means the temperature as the detection result of the temperature detecting means 4T provided in the developing device 4. "o" represents the image quality deterioration did not occur, and "x" represents that the image quality deterioration occurs in terms of at least one of deteriorations of degrees of the fog, the toner scattering, and the graininess.

From FIG. 7 showing the result of the experiment, the followings can be understood. That is, in the case where the temperature is low (e.g., at 20° C.), the toner deterioration progression is slow, so that the image quality deterioration does not occur even when the print ratio is low to some extent (even when the print ratio is 2% at 20° C.). On the other hand, in the case where the temperature is high (e.g., at 50° C.), the toner deterioration progression is rapid, so that the image quality deterioration occurs unless the print ratio is higher (unless the print ratio is 5% or more).

In other words, in the image forming apparatus in this embodiment, unless the image formation is effected at a certain print ratio or more (i.e., at a certain value or more of the video count), the image quality deterioration due to the toner deterioration, such as the deterioration of the degree of the fog, the toner scattering or the graininess. Further, the print ratio which is the threshold at which the image quality deterioration occurs (i.e., the video count which is the threshold) varies depending on the temperature of the developer in the developing device.

In this embodiment, in order that the image quality deterioration due to the toner deterioration is not caused to occur, the video count corresponding to a minimum necessary amount of toner consumption is defined as a "toner deterioration threshold video count Vt". The toner deterioration threshold video count Vt is the value varying depending on the developer temperature as described above and is also a value which can be calculated by the above-described experiment or the like. Here, in FIG. 8(*b*), values of the toner deterioration threshold video count Vt at the respective temperatures for the respective colors are shown. Incidentally, the toner deterioration threshold video count Vt varies depending on the color and material of the developer (the toner and the carrier), the constitution of the developing device, and the like and therefore may be appropriately calculated and set. For example, in the case where the melting point of the toner is different, the toner deterioration threshold at the same temperature may be made higher with a lower melting point. As a result, depending on the developing device for each of the colors, execution timing or execution time (length) of the forced discharging operation may be changed.

<Control Method of Toner Forced Consumption>

Next, the control method and operation condition of the toner forced consumption operation (forced toner consumption operation) will be described. First, as a precondition, a concept of the toner forced consumption and the control method for each of the colors is the same. Therefore, the colors are omitted from description along the following flow charts is some cases but in which common control is effected for each of the colors. In this embodiment, as an easy-to-understand example, the case where such an image that the print ratios per (one) sheet for the colors of Y, M, C and K are 5% for Y, 5% for M, 5% for C and 3% for K (hereinafter, this image is referred to as a "black low duty image chart") is continuously formed on A4-sized sheets is considered. The toner discharging control in this case is described along the flow chart shown in FIG. 9.

When the image formation is started, as described above with reference to FIG. 3, the video signal count portion 207 calculates video counts V(K), V(M), V(C) and V(K) for the respective colors (step S1). In this embodiment, the video count of the whole (entire) surface solid image (the image with the print ratio of 100%) on one surface of A4-sized sheet for a certain color is 512. The video counts of the "block low duty image chart" are V(Y)=26, V(M)=26, V(C)=26 and V(K)=15. Here, when each video count is calculated, the fractional portion of the number is rounded off to the nearest integer.

Then, the toner deterioration threshold video count Vt at the current temperature is calculated from the detection result of the temperature detecting means 4T and the table (FIG. 8(*b*)) of the toner deterioration threshold video count Vt (step S2). Here, as described above with reference to FIGS. 4 to 6, the temperature detecting means 4T in this embodiment is the band gap temperature sensor capable of directly measuring the temperature of the developer in the developing container. As a substitute for the temperature detecting means 4T, it is also possible to use an environment sensor generally provided in the image forming apparatus main assembly. However, in order to realize maximum compatibility between the productivity and the image quality by increasing the (calculation) accuracy of the toner deterioration threshold video count Vt to optimize the toner discharging control, the temperature detecting means for directly detecting the temperature of the developer in the developing container as in this embodiment is desirable.

Figure 10:
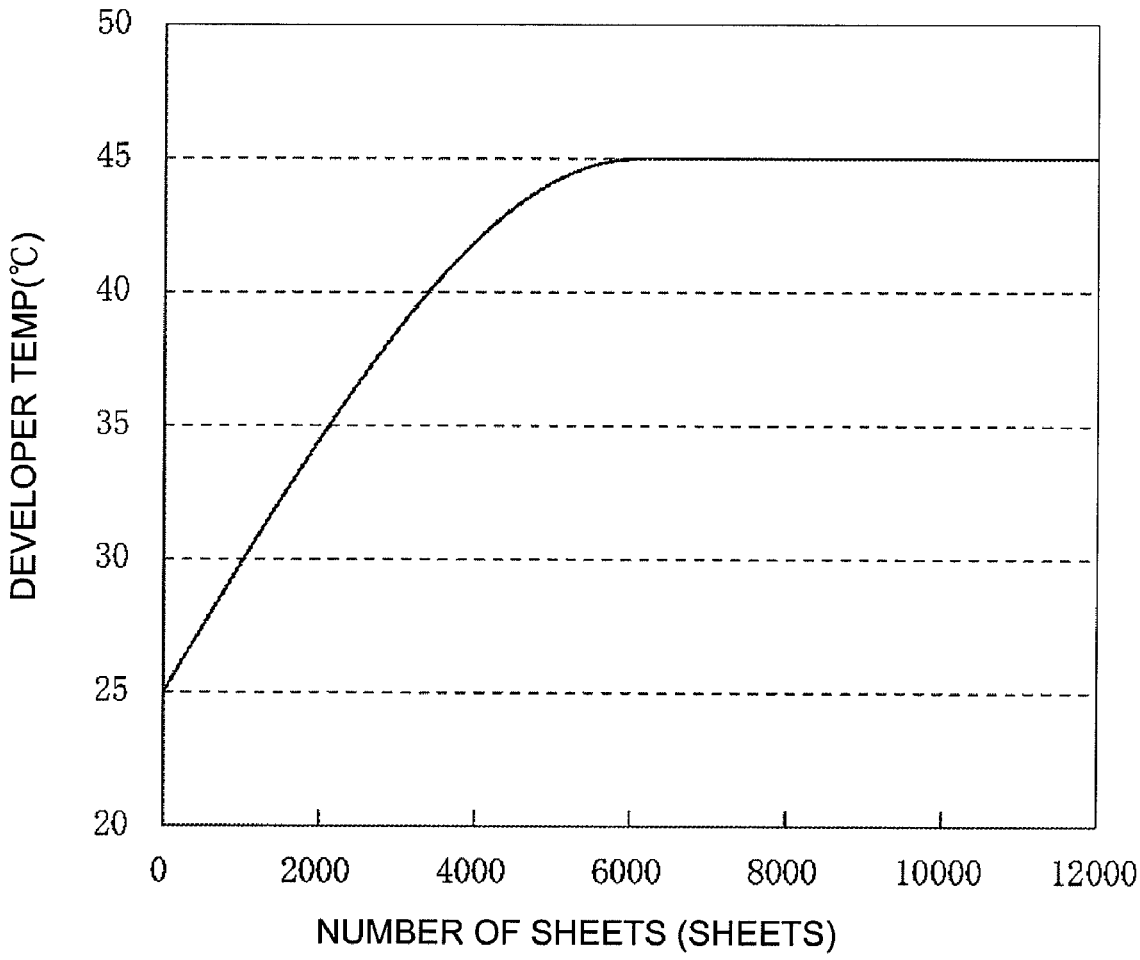
FIG. 10 is a graph showing temperature rise of a developer in the image forming apparatus in Embodiment 1 during continuous image formation.

Here, progression of the detection result of the temperature detecting means 4T(K) provided in the developing device for black in the case where the above-described "black low duty image chart" is continuously formed on the A4-sized sheets is shown in FIG. 10. In this case, the image forming apparatus is placed in a fixed environment for room temperature of 23° C. and relative humidity of 50% RH. In FIG. 10, the abscissa represents the number of sheets subjected to the continuous image formation, and the ordinate represents the detection result (the developer temperature) of the temperature detecting means 4T. As is understood from the graph of FIG. 10, even when the disposition environment of the image forming apparatus is kept constant (room temperature of 23° C. and relative humidity of 50% RH), the detection result of the temperature detecting means 47 (i.e., the temperature of the developer) is increased gradually. However, the developer temperature is saturated at about 45° C. This temperature rise may be attributable to self-temperature-rise by the rotation of the developing sleeve or feeding screws in the developing device or self-temperature-rise of other member in the image forming apparatus such as a motor. Therefore, the toner deterioration threshold video count Vt used for the calculation of the toner discharging control is changed depending on the number of sheets subjected to the continuous image formation.

Figure 9:
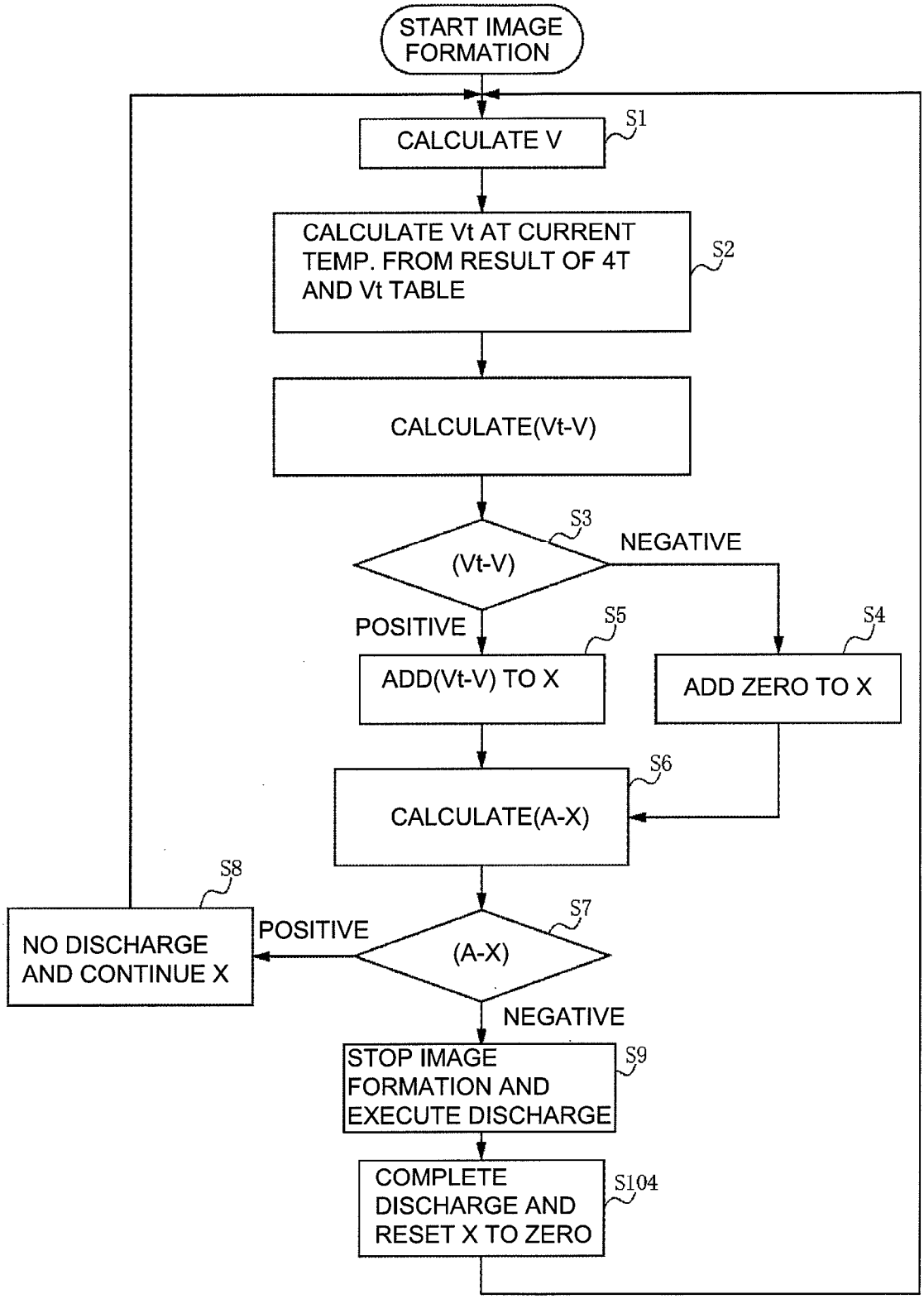
FIG. 9 is a flow chart of toner discharging control in the image forming apparatus in Embodiment 1.

Referring again to the flow chart of FIG. 9, a difference between the video count V and the toner deterioration threshold video count Vt, i.e., the sign (positive or negative) of (Vt−V) is judged (step S3). First, in the case where (Vt−V) is negative, the print ratio is high and thus the toner is in a state in which the toner deterioration does not go, so that 0 (zero) is added to a toner deterioration integrated value X (step S4). On the other hand, in the case where (Vt−V) is positive, the print ratio is low and thus the toner is in a state in which the toner deterioration goes, so that (Vt−V) is added to the toner deterioration integrated value X. Here, the toner deterioration integrated value is an index which indicates a current toner deterioration state, and is an integrated value of the video count value calculated by (Vt−V).

Further, with respect to the toner deterioration integrated value X calculated and updated every image formation in the above steps, a difference (A−X) of the toner deterioration integrated value X from a discharge execution threshold is calculated (step S6). Here, the discharge execution threshold A is a print ratio value which is arbitrarily settable. The smaller the discharge execution threshold A, the higher the frequency of execution of the toner discharging operation even in the continuous image formation at the same print ratio. The discharge execution threshold A is set at 512 in this embodiment. When the set value of the discharge execution threshold A is excessively large, a time in which the toner deterioration goes until the toner discharging operation is performed is long, so that it is desirable that the set value is approximately equal to the video count value of the whole surface solid image (the image with the print ratio of 100%) on one surface of A4-sized sheet to A3-sized sheet. Further, e.g., with a larger volume of the developer which can be retained in the developing container 20, there is a tendency that the toner discharge execution threshold A can be set at a larger value.

Finally, the sign (positive or negative) of the difference (A−X), between the toner deterioration integrated value X and the discharge execution threshold A, calculated in the preceding step is judged (step S7). Here, in the case where (A−X) is positive, the toner is judged that the toner deterioration does not go to the extension that the toner discharging is required to be performed immediately, so that the image formation is continued (step S8). On the other hand, in the case where (A−X) is negative, the toner is judged that the toner deterioration goes considerably and therefore there is a need to execute the toner discharging immediately, so that the image formation is interrupted and then the toner discharging operation is performed (step S9).

Figure 11:
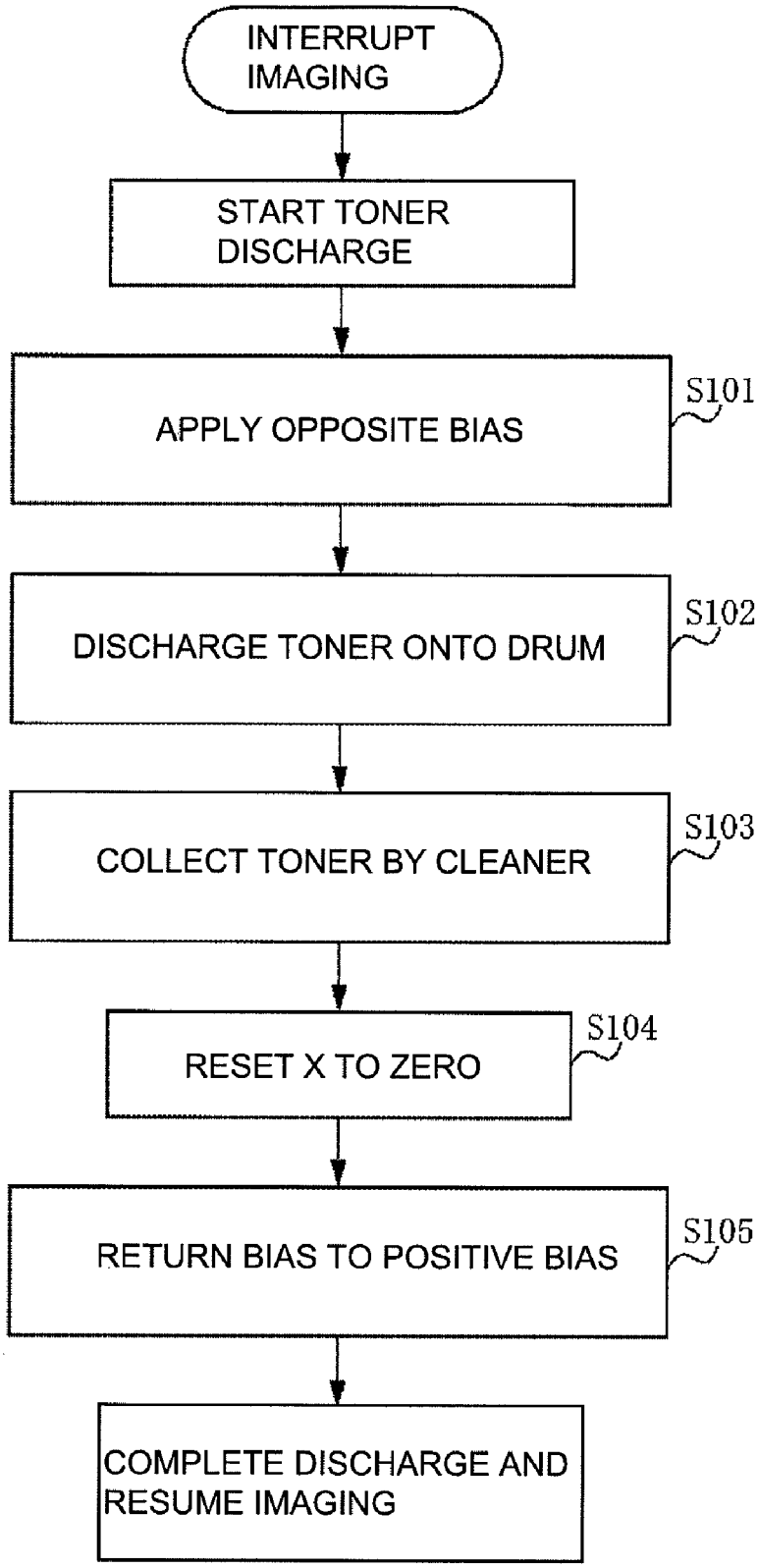
FIG. 11 is a flow chart of an operation of the image forming apparatus in the toner discharging control in Embodiment 1.

Here, the toner discharging operation will be described with reference to FIG. 11. In the preceding steps, in the case where (A−X) is the negative value, a controller (CPU) 1007 (FIG. 15) as the control means interrupts the image formation and performs the toner discharging operation. First, as the primary transfer bias, a transfer bias of an opposite polarity to that during the normal image formation (i.e., the transfer bias of an identical polarity to the charge polarity of the toner image on the photosensitive drum) is applied (step S101). Next, the toner in the amount corresponding to the video count equivalent to the discharge execution value A is discharged onto the photosensitive drum (step S102). Incidentally, during the discharging operation (during the forced consumption operation), the discharging operation may preferably controlled so that at least the developing sleeve is rotated one-full turn or more. The latent image, on the photosensitive drum, for the toner discharging may desirably be the whole surface solid image with respect to the longitudinal direction of the photosensitive drum in order to minimize the downtime by the discharging. Further, the toner discharged on the photosensitive drum is not transferred onto the intermediary transfer belt since the primary transfer bias has the same polarity as that of the toner, and is collected by a photosensitive drum cleaner (step S103). Here, the toner deterioration integrated value X is reset to 0 (zero) (step S104). Finally, the primary transfer bias is returned to that of the (positive) polarity during the normal image formation (step S105), the toner discharging operation is completed and the normal image forming operation is resumed.

Here, in the above-described toner discharge control method, the case where the above-described "black low duty image chart" is subjected to the continuous image formation on 10,000 sheets will be considered specifically.

First, in the case where the "black low duty image chart" is formed on one sheet, how to calculate the toner deterioration integrated value X for each color in the toner discharge control in this embodiment is shown in FIG. 12. As shown in FIG. 12, in the image formation of the "black low duty image chart", with respect to Y (yellow), M (magenta) and C (cyan), the print ratio is always sufficiently high and therefore the toner deterioration integrated value is always 0 (zero).

On the other hand, with respect to K (black), in the first half of the continuous image formation, the toner deterioration integrated value X per one sheet is zero but as described above, the developer temperature is increased with a later stage in the latter half of the continuous image formation (FIG. 10). The toner deterioration threshold video count Vt becomes larger with an increasing temperature (FIG. 8), so that the toner deterioration integrated value X is increased from 0 to +11. That is, this means that the black toner deterioration does not go in the first half of the continuous image formation but goes in the latter half of the continuous image formation.

More specifically, from FIGS. 8(*a*), 8(*b*) and 10, in the continuous image formation of the "black low duty image chart" on 10,000 A4-sized sheets, the toner discharging operation is not performed in the range of 0-3,000 sheets. Then, in the range of 3,001-6,000 sheets, the toner deterioration integrated value X per one sheet is +5, so that the toner discharging is executed. The execution frequency is every 512/5=103 sheets (rounded up to the next integer) since the discharge execution threshold A is 512. Further, in the range of 6,001-10,000 sheets, the toner deterioration integrated value X per one sheet is +11 m so that the toner discharging is executed. The execution frequency is every 512/11=47 sheets (rounded up to the next integer) since the discharge execution threshold A is 512.

The controller 1007 controls the operation condition so that the execution frequency in the case where the temperature in the developing device is higher than a print ratio temperature is higher than that in the case where the temperature in the developing device is lower than the print ratio temperature, on the basis of the detection result of the temperature detecting means 4T. That is, the controller 1007 controls the operation condition so that the amount of the toner discharged per unit image formation satisfies the following relationship in the case where the image is continuously formed at the same print ratio. That is, the controller 1007 controls the operation condition so that the amount of the toner discharged per unit image formation in the case where the temperature in the developing device is higher than the print ratio temperature is larger than that in the case where the temperature in the developing device is lower than the print ratio temperature. Here, the continuous image forming operation means a series of image forming operations for continuously forming the image on a plurality of sheets of the recording material.

Figure 15:
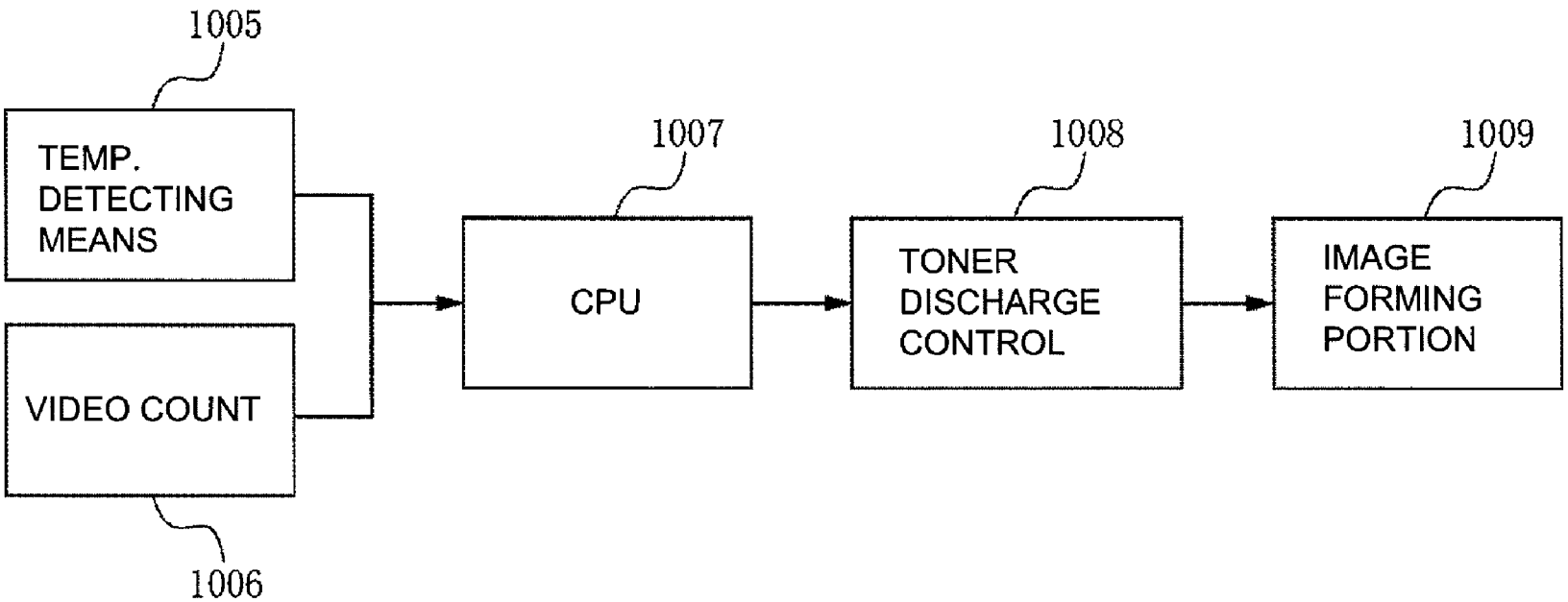
FIG. 15 is a control block diagram of the toner discharging operation in the image forming apparatuses in Embodiments 1 and 2.

Further, a simple control block diagram is shown in FIG. 15. As shown in FIG. 15, pieces of information on the detection result of the temperature detecting means 1005 and on the result of the video count 1006 are sent to the CPU 1007 and in accordance with toner discharge control 1008 described with reference to the flow charts of FIGS. 9 and 11, the CPU 1007 provides instructions to execute the toner discharging operation to an image forming portion 1009.

In the above-described manner, in this embodiment according to the present invention, in the continuous image formation of the "black low duty image chart" on the 10,000 A4-sized sheets, the toner discharging is executed while interrupting the image formation about 115 times. Further, by one toner discharging operation, the toner in the amount corresponding to the video count of 512 is consumed. Here, in the conventional toner discharge control, the change in toner deterioration threshold value by temperature is not factored, so that the toner deterioration integrated value X per one sheet during the continuous image formation on, e.g., 10,000 sheets is always t11 and thus the toner discharging is required to be executed about 214 times. Therefore, by employing this embodiment according to the present invention, the frequency of the toner discharging operation can be reduced by half and in addition, the toner consumption amount can also be reduced by half.

According to the constitution in this embodiment, during the continuous image formation for continuously forming the image on the plurality of sheets of the recording material, the operation condition is controllable so that the frequency of the discharging operation executed per unit number of sheets subjected to the image formation is higher with a higher temperature in the developing device. Thus, the suppression of the downtime can be realized while realizing the suppression of the toner deterioration.

Incidentally, in this embodiment, the execution frequency of the discharging operation is changed on the basis of the temperature in the developing device but the discharge amount (execution time) in one discharging operation may also be changed.

(Embodiment 2)

In Embodiment 1 described above, the control method of performing the efficient toner discharging operation was proposed by paying attention to the fact that the toner deterioration goes in the case where the print ratio per one sheet is low (i.e., in the case where the video count is small) and that the degree of the toner deterioration progression varies depending on the temperature. In this embodiment, a method in which attention is paid to dependency of the deterioration of the toner in the developer on (1) a driving time of the developing sleeve, (2) the toner consumption amount per unit time, and (3) the temperature of the developer at that time and then the toner discharging operation is controlled will be described.

<Control Method of Toner Forced Consumption>

First, as a precondition, a concept of the toner forced consumption and the control method for each of the colors is the same. Therefore, the colors are omitted from description along the following flow charts is some cases but in which common control is effected for each of the colors. Also in this embodiment (Embodiment 2), for the purpose of easy-to-understand description, the case where the "black low duty image chart" with the print ratios per (one) sheet for the colors of Y, M, C and K are 5% for Y, 5% for M, 5% for C and 3% for K is continuously formed on A4-sized sheets is considered. The toner discharging control in this case is described along the flow chart shown in FIG. 13.

First, every print ratio number (A) of sheets, a total sleeve rotation time integrated value St and a total toner consumption amount video count Vall are calculated (step S201). Here, the print ratio number (A) of sheets is an arbitrarily determined value in the image forming apparatus in this embodiment and may desirably be about 100 sheets. Further, the total sleeve rotation time integrated value St is a total integrated value of a sleeve rotation time from start of the image formation to completion of the image formation on the print ratio number (A) of sheets and contains the sleeve rotation time during sheet intervals, pre-rotation, and the like. Further, the total toner consumption amount video count Vall is a value which indicates a total toner consumption amount from the start of the image formation to the completion of the image formation on the print ratio number (A) of sheets. This value also contains the amount of the toner consumed by patches for density control, toner supply control, misregistration correction, and the like, in addition to the video count calculated by the above-described video signal count portion 207 shown in FIG. 3 during the normal image formation on the original. Here, the toner consumption amount by the patches for control described above may be appropriately set depending on the image forming apparatus to which the present invention is to be applied. For example, in this embodiment, the patch for density control is a square patch of 20 mm×20 mm in area, and the toner amount (per unit area) is one-half that of the solid image. Therefore, the video count for one time application of the patch for density control is 512×0.5 (density correction)×[(20×20)/(297×210)] (area correction)=2.

Next, a toner consumption amount per unit driving time (Vall/St) is calculated from the total sleeve rotation time integrated value St and the total toner consumption amount video count Vall which are (Vall/St) is a value which indicates a degree of the toner deterioration.

Further, a threshold T (which depends on the temperature) of the toner consumption amount per unit drive time in which the toner deterioration goes will be considered. The threshold T can be calculated by investigating a change in image quality before and after the experiment described above with reference to FIG. 7, i.e., the continuous one-side image formation on 10,000 A4-sized sheets conducted under each of the various constant environments in which the developing device 4 is placed and conducted at the print ratios for the colors (changed from 0% to 5%). That is, the video count for the normal image formation is obtained from the print ratio and the video count of the toner consumption amount by the patches for control is obtained from the number of sheets subjected to the image formation, so that the total toner consumption amount video count Vall can be calculated by calculating the sum of these video counts. Further, the total sleeve rotation time integrated value St can be measured. Thus, it is possible to confirm a correlation between the toner consumption amount per unit drive time (Vall/St) and the image quality. Here, values of the threshold T of the toner consumption amount per unit drive time in which the toner deterioration goes are shown in the table of FIG. 14 with respect to each of the colors and each of the temperatures in the image forming apparatus in this embodiment. Incidentally, the threshold T varies depending on the color and material of the developer (the toner and the carrier), the constitution of the developing device, and the like and therefore may be appropriately calculated and set. However, a unit of the threshold T is (video count/sec). Here, referring again to the flow chart of FIG. 13, the threshold T at an average temperature of T1 (before image formation) and T2 (after image formation) which are the detection result of the temperature detecting means 4T before and after the image formation on the print ratio number (A) of sheets (step S203).

In a subsequent step (step S204), the sign (positive or negative) of a difference between the above-described toner consumption amount per unit drive time (Vall/St) and the threshold T of the toner consumption amount calculated in step S203, i.e., T−(Vall/St) is judged. That is, the controller controls the forced consumption operation on the basis of the average of the result of the detection by the temperature detecting sensor 4T before and after the image formation on the print ratio number of sheets.

First, in the case where T−(Vall/St) is negative, the toner consumption amount per unit drive time is sufficiently large, so that the toner deterioration has not gone. Therefore, the toner discharging operation is not performed in the case where T−(Vall/St) is negative and both of the total sleeve rotation time integrated value St and the total toner consumption amount video count Vall are reset to zero (step S206) and then the image formation is continued.

On the other hand, in the case where T−(Vall/St) is positive, the toner consumption amount per unit drive time is small and therefore the toner deterioration has gone. For this reason, in the case where T−(Vall/St) is positive, the toner discharging operation is performed so that the toner in the amount corresponding to the video count calculated by Vall−(T×St) is consumed (step S205). That is, the controller judges whether or not the toner discharging operation (the forced consumption operation) should be performed, every print ratio number of sheets subjected to the image formation. Here, the operation flow chart of the toner discharging operation itself is similar to that of FIG. 11 described above in Embodiment 1. Then, as shown in FIG. 13, both of the total sleeve rotation time integrated value St and the total toner consumption amount video count Vall are reset to zero (step S206) and the image formation is continued.

Incidentally, in this embodiment, the case where the rotational speed of the developing sleeve is constant is described but in the case where a plurality of rotational speeds is employed, these rotational speeds may also be taken into consideration. Specifically, in step S202, a toner consumption amount per unit drive amount Vall/(St×Vsl) is calculated by using a developing sleeve speed Vsl in addition to the total sleeve rotation time integrated value St and the total toner consumption amount video count Vall. In this case, a unit of the threshold T is [video count/(sec.rotation speed)] and a similar flow is executed. For example, based on the sign (positive or negative) of T−(Vall/(St×Vsl)], judgment as to whether or not the discharging operation should be performed may be made. In the case where T−(Vall−(St×Vsl) is positive, the toner in the amount corresponding to the video count calculated by Vall−(T×St×Vsl) may be consumed.

Figure 13:
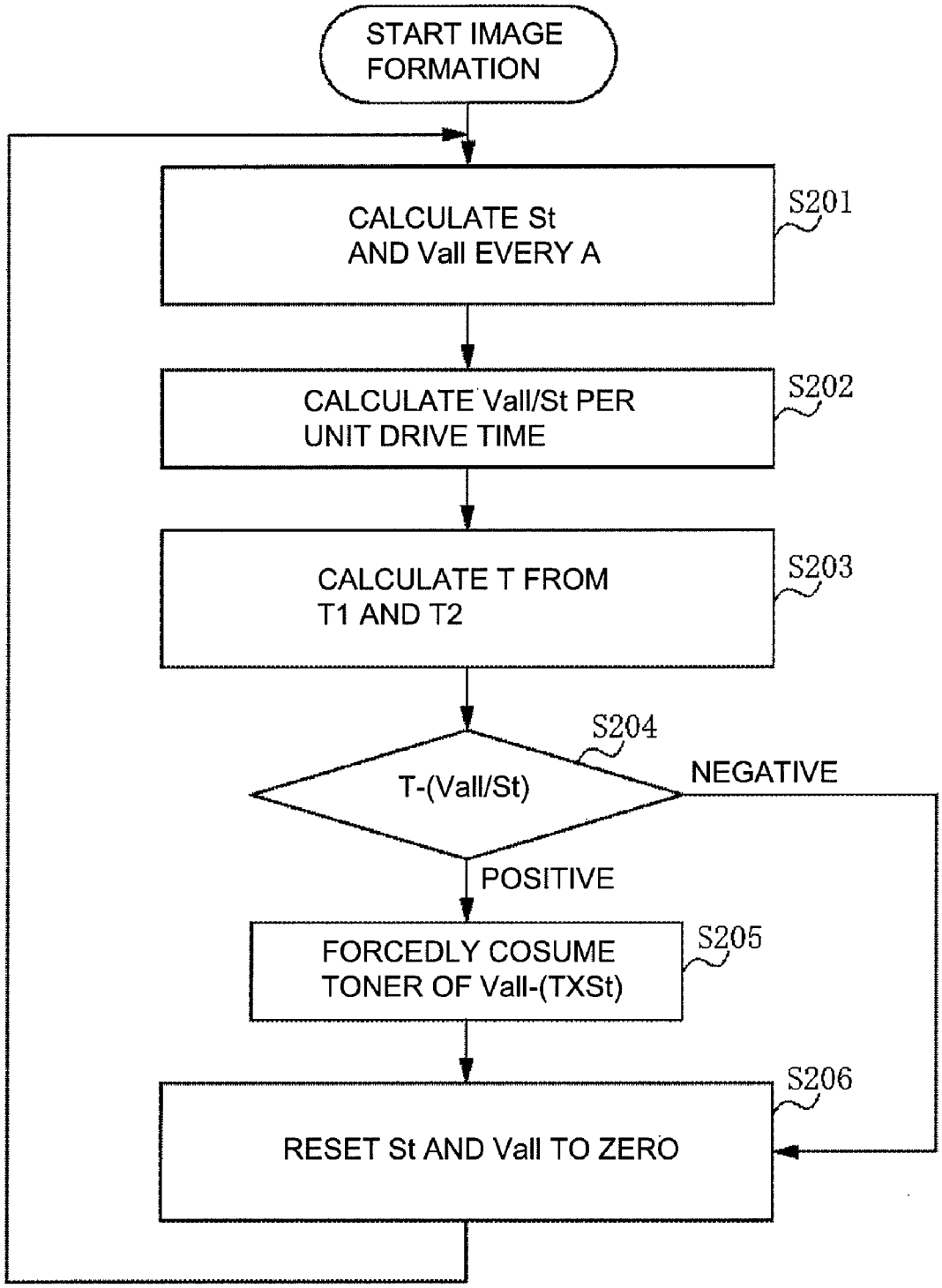
FIG. 13 is a flow chart of an image in an image forming apparatus in toner discharging control in Embodiment 2.

Along the flow chart of FIG. 13 described above, only black in the case where the "black low duty image chart" is continuously formed on 10,000 A4-sized sheets will be considered specifically. The detection result of the developer temperature by the temperature detecting means 4T is similar to that shown in FIG. 10. Further, in the flow chart of FIG. 13, the print ratio number (A) of sheets is 100 sheets. In this case, in this embodiment, the total sleeve rotation time integrated value St at the print ratio number (A) of 100 sheets is 70 sec. Further, the total toner consumption amount video count Vall at the print ratio number (A) of 100 sheets is 1520 since the video count per one image sheet is 15 and the video count for one time application of the patch for density control effected every 10 sheets during the continuous image formation is 2. However, in this embodiment, the patch for supply control and the patch for misregistration control are neglected since a patch formation frequency of these particles is small and thus the toner consumption amount is very small. Therefore, the toner consumption amount per unit drive time (Vall/St) is 22 (rounded up to the next integer).

Here, the calculated toner consumption amount per unit drive time (Vall/St) of 22 during the image formation on the print ratio number (A) of 100 sheets and the threshold T of the toner consumption amount per unit drive time in which the toner deterioration goes shown in the table of FIG. 14 are compared. In this case, it is understood that the toner discharging is not executed until the temperature is 35° C. or more. From the graph of FIG. 10 showing the temperature change, the developer temperature is less than 35° C. during the image formation on 2,000 sheets, so that it is understood that the toner discharging is not executed. Further, when the number of sheets is 8,000 sheets in the later stage in the latter half of the image formation, the toner discharging is executed every print ratio number (A) of 100 sheets. That is, the number of interruption of the image formation by the toner discharging is 80 times in Embodiment 2.

On the other hand, as a conventional embodiment, in the case where the toner discharging is executed every print ratio number of sheets, the toner discharging is executed 20 times (=2000/100) during the image formation on 2,000 sheets in the first half of the image formation, so that the deterioration of the image quality cannot be prevented unless the toner discharging is executed 100 times in total. Further, the toner forced consumption (discharge) controlling in Embodiment 2 is also effected in accordance with the control block diagram of FIG. 15 similarly as in Embodiment 1. As described above, also in Embodiment 2 according to the present invention, the toner discharging can be executed more efficiently than the conventional embodiment by paying attention to the temperature dependence of the toner deterioration.

According to the present invention, it is possible to provide an image forming apparatus, including a developing device and a toner discharging means for preventing the toner deterioration described above, capable of alleviating the lowering in productivity while preventing the toner deterioration by changing the toner discharging operation depending on the temperature in the developing device.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195702/2009 filed Aug. 26, 2009, which is hereby incorporated by reference.

What is claimed is:

1. An image forming apparatus comprising:

a developing device for developing a latent image formed on an image bearing member into a developer image;

a transferring device for transferring the developer image from the image bearing member onto a transfer material;

a temperature detecting sensor, disposed in a main assembly of said image forming apparatus, for detecting a temperature; and a controller for executing, when an integrated value of a difference between a first threshold and output image video count, the image video count being not more than the first threshold, exceeds a second threshold, a forced consumption operation in which toner is forcedly consumed by said developing device without transferring the developer image from the image bearing member onto the transfer material, wherein the first threshold is set based on the temperature detected by said temperature detecting sensor, such that when the temperature is higher than or equal to a predetermined temperature the first threshold is higher than when the temperature is lower than the predetermined temperature.

2. An apparatus according to claim 1, wherein the integrated value is reset after the forced consumption operation is executed.

3. An image forming apparatus comprising:

a plurality of image bearing members;

a plurality of developing devices, including developer carrying members for carrying and conveying developers different in color, for developing latent images formed on the image bearing members into developer images;

a transferring device for transferring the developer images from the image bearing members onto a transfer material;

a temperature detecting sensor for detecting information on a temperature in each developing device; and a controller for executing, for each developing device and for every predetermined print number, an operation in which a toner is forcedly consumed by transferring the developer image from the developing device onto the developer carrying member without transferring the developer image from the image bearing member onto the transfer material, wherein the controller executes the operation when information on toner consumption per unit drive time of the developer carrying member is below a predetermined threshold, and wherein the predetermined threshold is set based on the temperature detected by said temperature detecting sensor, such that when the temperature is higher than or equal to a predetermined temperature the predetermined threshold is higher than when the temperature is lower than the predetermined temperature.

4. An apparatus according to claim 3, wherein the information on toner consumption is reset after the operation by the developing device is executed.

* * * * *